US010606200B2

(12) United States Patent
Kojima

(10) Patent No.: US 10,606,200 B2
(45) Date of Patent: Mar. 31, 2020

(54) IMAGE FORMING APPARATUS HAVING TONER CONCENTRATION DETECTION

(71) Applicant: CANON KABUSHIKI KAISHA, Tokyo (JP)

(72) Inventor: Takehiro Kojima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/424,781

(22) Filed: May 29, 2019

(65) Prior Publication Data

US 2019/0278208 A1 Sep. 12, 2019

Related U.S. Application Data

(63) Continuation of application No. PCT/JP2017/043895, filed on Nov. 30, 2017.

(30) Foreign Application Priority Data

Dec. 1, 2016 (JP) ..... 2016-234193

(51) Int. Cl.
*G03G 15/10* (2006.01)
*G03G 15/00* (2006.01)

(52) U.S. Cl.
CPC ..... *G03G 15/5004* (2013.01); *G03G 15/105* (2013.01); *G03G 15/5016* (2013.01); *G03G 2215/0658* (2013.01)

(58) Field of Classification Search
CPC ..... G03G 15/105; G03G 15/5004; G03G 15/5016; G03G 15/55; G03G 15/553; G03G 15/556; G03G 2215/0658
See application file for complete search history.

(56) References Cited

U.S. PATENT DOCUMENTS 8,355,643 B2 1/2013 Kojima et al.
2004/0184829 A1* 9/2004 Shin ..... G03G 15/105 399/57

(Continued)

FOREIGN PATENT DOCUMENTS

JP 2000-267427 A 9/2000
JP 2002-287513 A 10/2002

(Continued)

OTHER PUBLICATIONS

Machine translation of JP 2008-083349 A (patent application No. 2006-262650) printed on Aug. 14, 2019.*

(Continued)

*Primary Examiner* — Sophia S Chen
(74) *Attorney, Agent, or Firm* — Venable LLP

(57) ABSTRACT

A developing roller is rotatable while carrying a liquid developer containing toner and a carrier liquid and contains an electroconductive agent, and includes a squeeze roller provided in contact with the developing roller through at least the carrier liquid, a voltage source capable of generating a potential difference between the developing roller and a squeeze roller, and a current detecting sensor for detecting a current passed between the developing roller and the squeeze roller. In addition, a controller controls the voltage source, and a display device outputs information on a lifetime of the developing roller. The controller outputs the information on the lifetime from the display device on the basis of a detection result by the current detecting sensor when a predetermined potential difference is generated between the developing roller and the squeeze roller by the voltage source.

6 Claims, 7 Drawing Sheets

(56) References Cited

U.S. PATENT DOCUMENTS

| | | | | |
|---|---|---|---|---|
| 2005/0169671 | A1* | 8/2005 | Kellie | G03G 15/101 399/237 |
| 2008/0076052 | A1* | 3/2008 | Nakamura | G03G 15/104 430/103 |
| 2008/0267641 | A1* | 10/2008 | Konishi | G03G 15/55 399/27 |
| 2010/0209156 | A1* | 8/2010 | Raz | G03G 15/0815 399/343 |
| 2012/0243887 | A1* | 9/2012 | Murata | G03G 15/0858 399/27 |
| 2014/0348526 | A1* | 11/2014 | Lopez | G03G 15/105 399/57 |

FOREIGN PATENT DOCUMENTS

| | | | |
|---|---|---|---|
| JP | 2003-156938 | A | 5/2003 |
| JP | 2006-317641 | A | 11/2006 |
| JP | 2008-083349 | A | 4/2008 |
| JP | 2008-170601 | A | 7/2008 |

OTHER PUBLICATIONS

PCT International Search Report and Written Opinion dated Feb. 27, 2018, in PCT/JP2017/043895.
Takehiro Kojima, U.S. Appl. No. 16/424,757.
Takehiro Kojima, U.S. Appl. No. 16/424,795.

* cited by examiner

IMAGE FORMING APPARATUS HAVING TONER CONCENTRATION DETECTION

This application is a continuation of PCT Application No. PCT/JP2017/043895, filed on Nov. 30, 2017.

TECHNICAL FIELD

The present invention relates to an image forming apparatus in which image formation is carried out by utilizing a developing device for developing an electrostatic latent image, carried on a latent image bearing member, through a wet developing type by using a liquid developer in which toner is dispersed in a medium liquid.

BACKGROUND ART

Electrophotography in which the electrostatic latent image formed on the latent image bearing member such as a photosensitive member is developed with charged (toner) and an image is formed has become widespread. As the electrophotography of this kind, for example, a dry developing method directly using powdery toner and a wet developing method (liquid developing system) using the liquid developer in which the toner is dispersed in a liquid exist. Of these, in the liquid developing system, the toner is dispersed in the medium (carrier) liquid, and therefore, image formation can be carried out by controlling particles with a particle size in a submicron order, and the liquid developing system is a promising developing method in terms of high image quality and high definition.

Further, the liquid developer is advantageous in handling such that for example, the toner is not scattered, and therefore, image formation at high speed is enabled. Therefore, the liquid developing system is frequently used in an image forming apparatus for professionals, such as light printing and graphic arts, in which the high image quality is required over a long term. For that reason, the liquid developing system is required not only that states of respective functional component parts contributing to the image formation are properly maintained but also that when the states are out of required performances, the functional component parts are appropriately replaced with those satisfying the performances.

In the liquid developing system, a developing process in which the electrostatic latent image drawn on the latent image bearing member (hereinafter, referred to as a photosensitive drum) is visualized with the toner is a most-upstream process for forming a toner image. Therefore, it is very important for properly maintaining the toner image on the photosensitive drum with a high image quality that the performance of a developer carrying member (hereinafter, referred to as a developing roller) performing the function of feeding the toner onto the photosensitive drum, i.e., that the developing roller is used within a lifetime range thereof.

The developing roller used in the liquid developing system is formed in general by using a metal shaft as a core and by providing a surface layer of an elastic member made of a polymer, a rubber material or the like of which electrical conductivity is adjusted, on a peripheral surface of the core. The developing roller reaches an end of a lifetime by deteriorations in a mechanical characteristic such as a surface property and in an electrical characteristic such as an electroconductive property, but as regards lifetime extension thereof, reduction of the deterioration in mechanical characteristic of the developing roller is relatively easier than reduction of the deterioration in electrical characteristic of the developing roller.

As an example of the deterioration in mechanical property, the following example exists. For example, there is a case that an application roller with surface unevenness is used for carrying the developer on a surface of the developing roller, but when the application roller directly contacts the developing roller, there is a liability that the surface of the developing roller is damaged, so that the deterioration in mechanical characteristic is invited. In order to reduce such a deterioration in mechanical property, for example, an image forming apparatus in which a liquid developer applied onto a surface of an application roller is applied onto the surface of a developing roller through an intermediary roller has been developed (Japanese Laid-Open Patent Application (JP-A) 2002-287513 and JP-A 2003-156938). According to this image forming apparatus, by providing the intermediary roller between the application roller and the developing roller, mechanical abrasion and damage due to unevenness of the application roller at the surface of the developing roller are reduced, so that lifetime extension of the developing roller can be realized.

On the other hand, as the electrical characteristic of the developing roller, in general, volume resistivity of the developing roller is optimized by dispersing and mixing an ion conductive agent into an elastic polymer constituting a surface layer. Before use of the developing roller, the ion conductive agent is uniformly dispersed in the surface layer, but during an image forming operation, different voltages are applied to the developing roller and the photosensitive drum or the like disposed at a periphery of the developing roller, and therefore, the dispersion of the ion conductive agent gradually generates localization. Therefore, volume resistivity of the surface layer of the developing roller increases with use. With the increase in volume resistivity of the surface layer of the developing roller, a shearing voltage applied to the surface layer of the developing roller increases in a gap between the developing roller and the photosensitive drum or the like, and therefore, a voltage applied to the develop becomes small compared with a desired value. Accordingly, when the volume resistivity of the surface layer of the developing roller increases up to the extent that the voltage applied to the developer is insufficient for image formation, the developing roller reaches the end of the lifetime. It is difficult to suppress the localization of the ion conductive agent, and therefore, the electrical characteristic of the surface layer of the developing roller, i.e., the electroconductive property constitutes a rate-determining factor of the lifetime. For this reason, in the image forming apparatus using the liquid developing system, exchange timing, i.e., the lifetime of the developing roller is determined depending on the number of image formation sheets which is a use frequency of the developing roller in some cases.

However, in the image forming apparatuses of the above-described JP-A 2003-156938 and JP-A 2003-156938, the exchange timing of the developing roller is determined depending on the number of image formation sheets by the developing roller. Here, the electroconductive property of the developing roller surface layer which constitutes the rate-determining factor is influenced by a using method such as an image ratio in addition to the number of image formation sheets of the developing roller, and in addition, there is also a difference among individuals of the developing rollers, and therefore, an actual lifetime of the developing roller cannot be discriminated with high accuracy only by a simple number of image formation sheets. For this reason, in order to determine the lifetime of the developing roller depending on the number of image formation sheets simply, in consideration of other factors which have the influence on the lifetime of the developing roller, there is a need to set the number of image formation sheets, which is the lifetime, at a small value. By this, the case where the developing roller is exchanged although the developing roller does not actually reach the end of the lifetime occurs, and an exchange frequency increases more than necessary, so that there is a liability that a running cost of the image forming apparatus is increased and that a lowering in productivity is invited by an increase in exchange operation.

The present invention aims at providing an image forming apparatus capable of discriminating a lifetime of a developing roller individually with high accuracy in the image forming apparatus using a liquid developing system.

MEANS FOR SOLVING THE PROBLEMS

According to an aspect of the present invention, there is provided an image forming apparatus comprising: a developing roller which is rotatable while carrying a liquid developer containing toner and a carrier liquid and which includes an electroconductive layer containing toner and a carrier; an electroconductive member for urging the developing roller; voltage applying means for forming a potential difference between the developing roller and the electroconductive member; current detecting means for detecting a current flowing between the developing roller and the electroconductive member; and a controller capable of controlling the voltage applying means, wherein the controller outputs information on exchange of the developing roller on the basis of a detected current value by the current detecting means when a predetermined potential difference is formed between the developing roller and the electroconductive member.

EFFECT OF THE INVENTION

According to the present invention, on the basis of a detection result of detection of a current passing between the developing roller and the electroconductive member by the current detecting means, the controller outputs the information on the lifetime. For this reason, when the electrical characteristic of the developing roller is deteriorated and volume resistivity becomes large, compared with the case where the lifetime of the developing roller is determined simply depending on the number of image formation sheets, an actual deterioration of the developing roller can be detected, so that the lifetime of the developing roller can be individually discriminated with high accuracy.

EMBODIMENTS FOR CARRYING OUT THE INVENTION

First Embodiment

In the following, a First Embodiment of the present invention will be specifically described while making reference to FIGS. 1 to 6. An image forming apparatus 1 of this embodiment is a digital printer of an electrophotographic type in which a toner image formed using a liquid developer containing toner and a carrier liquid is formed on a recording material. In this embodiment, as an example of the image forming apparatus 1, a full-color printer of a tandem type is described. However, the present invention is not limited to the image forming apparatus 1 of the tandem type but may also be an image forming apparatus of another type. Further, the image forming apparatus is not limited to the image forming apparatus for a full-color image, but may also be an image forming apparatus for a monochromatic image or an image forming apparatus for a mono-color (single color) image. Or, the image forming apparatus can be carried out in various uses, such as printers, various printing machines, copying machines, facsimile machines and multi-function machines.

Figure 1:
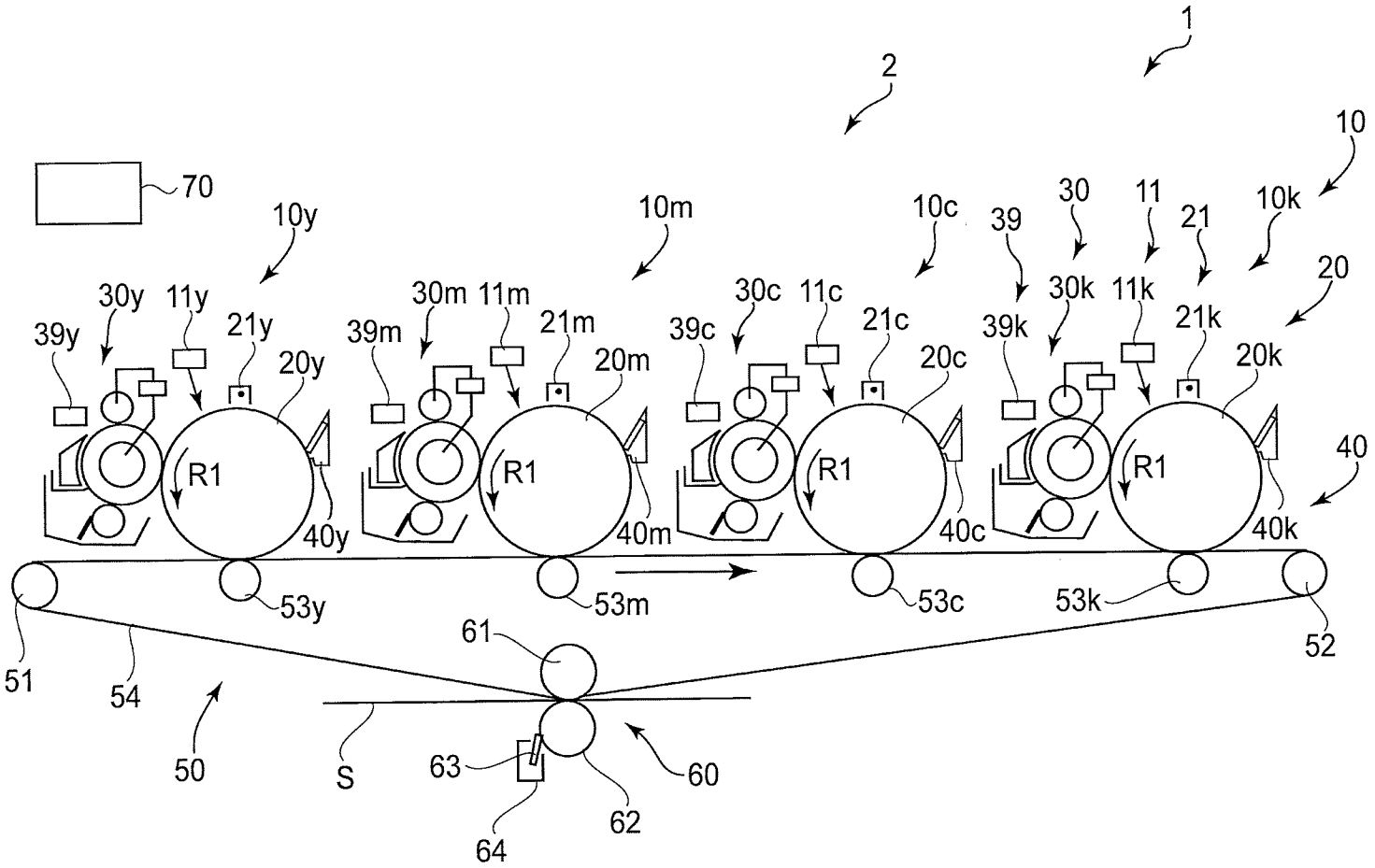
FIG. 1 is a schematic sectional view showing an image forming apparatus according to a First Embodiment.

As shown in FIG. 1, the image forming apparatus 1 includes an image forming portion 2 and a controller 70, and in addition, includes an unshown sheet feeding portion, an unshown sheet conveying portion and an unshown sheet discharging portion. Further, on a front-side upper surface of an apparatus main assembly of the image forming apparatus 1, for example, a display device (output means) 3 comprising a liquid crystal panel is provided (see FIG. 3). The image forming apparatus 1 is capable of forming a full-color image of four colors on the recording material depending on an image signal from an unshown original reading device, an unshown host device such as a personal computer, or an unshown external device such as a digital camera or a smartphone. Incidentally, on a sheet S as the recording material, the toner image is to be formed, and specific examples of the sheet S may include plain paper, a resin-made material sheet as a substitute for the plain paper, thick paper, a sheet for an overhead projector, and the like.

The image forming portion 2 includes image forming units 10*y*, 10*m*, 10*c*, 10*k*, laser scanners 11*y*, 11*m*, 11*c*, 11*k*, an intermediary transfer unit 50, a secondary transfer unit 60 and an unshown fixing device. Incidentally, the image forming apparatus 1 in this embodiment meets full-color image formation, and the image forming units 10*y*, 10*m*, 10*c*, 10*k* have similar constitutions for four colors of yellow (y), magenta (m), cyan (c), black (k), respectively, and are separately provided. For this reason, in FIG. 1, respective constituent elements for the four colors are represented by adding identifiers for the colors subsequently to the same symbols, but in FIG. 2 and in the specification, are described using only the symbols without adding the identifiers for the colors in some cases.

The image forming unit 10 includes photosensitive drums (image bearing members) 20*y*, 20*m*, 20*c*, 20*k*, chargers 21*y*, 21*m*, 21*c*, 21*k*, and developing devices 30*y*, 30*m*, 30*c*, 30*k*. Further, the image forming unit 10 includes developer mixers 39*y*, 39*m*, 39*c*, 39*k* and drum cleaners 40*y*, 40*m*, 40*c*, 40*k*. Similarly as the image forming unit 10, these have the same constitution for the four colors of yellow (y), magenta (m), cyan (c), black (k), respectively, and are separately provided. For this reason, in FIG. 1, respective constituent elements for the four colors are represented by adding the identifiers for the colors subsequently to the same symbols. The image forming unit 10 is integrally assembled into a unit as a cartridge and is constituted so as to be mountable in and dismountable from the apparatus main assembly of the image forming apparatus 1.

The photosensitive drum 20 is a drum-like electrophotographic photosensitive member including a cylindrical base material and a photosensitive layer which is formed on an outer peripheral surface of the base material and which is constituted by an organic photosensitive member or an amorphous silicon photosensitive member or the like, and is rotated about a center axis in an arrow R1 direction in the figures by an unshown drum motor. In this embodiment, as the photosensitive layer of the photosensitive drum 20, an amorphous silicon photosensitive layer is used. A width of the photosensitive drum 20 is made broader than a width of a developing roller (see FIG. 2) described later. The photosensitive drum 20 circulates and moves while carrying an electrostatic image formed on the basis of image information when an image is formed. The photosensitive drum 20 is movable while carrying a toner image formed using a liquid developer.

The charger 21 is provided substantially in parallel to the center axis of the photosensitive drum 20 and electrically charges a surface of the photosensitive drum 20 uniformly to a negative potential (dark portion potential) of the same polarity as negatively chargeable toner by a developing bias. Further, as the charger 21, a corona charger is used. However, as the charger 21, it is not limited to the corona charger, but a charging roller or the like may also be applied.

The laser exposure device 11 subjects the surface of the photosensitive drum 20 charged to the dark portion potential, to exposure by irradiation with laser light on a side downstream of the charger 21 with respect to an R1 direction and causes a potential drop to a light portion potential at an exposure portion, so that the electrostatic latent image is formed on the surface of the photosensitive drum 20. In this embodiment, the laser exposure device 11 irradiates the photosensitive drum surface with the laser light modulated depending on an image signal of an original, so that the laser light is projected onto the surface of the photosensitive drum 20 via an unshown polygon mirror, an unshown fθ lens and the like.

The developing device 30 is a device for developing the latent image, formed on the photosensitive drum 20, with liquid toner. Details of the developing device 30 will be described later. The developer mixer 39 supplies the liquid developer to the developing device 30 and includes a developer concentration sensor (toner concentration detecting means) 39*a* (see FIG. 2) capable of detecting the toner concentration of the liquid developer supplied to the developing roller 31. The developer concentration sensor 39*a* is, for example, a sensor utilizing light transmission and is used for calculating a weight percentage concentration (T/D) [wt. %] of the toner to the liquid developer supplied from the developer mixer 39.

The drum cleaner 40 is disposed on a side downstream of a primary transfer portion described later with respect to the R1 direction and includes a cleaning blade 41 (see FIG. 2). The cleaning blade 41 is contacted to the photosensitive drum 20 at a predetermined angle and a predetermined pressure by an unshown pressing means, so that the liquid developer remaining on the photosensitive drum 20 is scraped off by the cleaning blade 41 and prepares for a subsequent process.

The intermediary transfer unit 50 includes a plurality of rollers such as a driving roller 51, a follower roller 52, and primary transfer rollers 53*y*, 53*m*, 53*c* and 53*k*, and includes the intermediary transfer belt 54 which is wound around these rollers and which is an endless belt for carrying the toner image. The primary transfer rollers 53*y*, 53*m*, 53*c*, 53*k* are disposed opposed to the photosensitive drums 20*y*, 20*m*, 20*c*, 20*k*, respectively, and contact the intermediary transfer belt 54, so that the toner images on the photosensitive drums 20 are primary-transferred onto the intermediary transfer belt 54 which is another image bearing member.

The intermediary transfer belt 54 forms the primary transfer portion between itself and the photosensitive drum 20 in contact with the photosensitive drum 20, and a primary transfer bias is applied to the intermediary transfer belt 54, whereby the toner image formed on the photosensitive drum 20 is primary-transferred at the primary transfer portion. A positive-polarity transfer bias is applied to the intermediary transfer belt 54 by the primary transfer rollers 53, whereby the toner images having the negative polarity on the photosensitive drums 20 are superposedly transferred successively onto the intermediary transfer belt 54.

The secondary transfer unit 60 includes a secondary transfer inner roller 61, a secondary transfer outer roller 62, an outer roller blade 63 and a cleaning liquid collecting portion 64. By applying a positive-polarity secondary transfer bias to the secondary transfer outer roller 62, a full-color toner image formed on the intermediary transfer belt 54 is transferred onto the sheet S. The secondary transfer outer roller 62 forms the secondary transfer portion between itself and the intermediary transfer belt 54 in contact with the intermediary transfer belt 54, and a secondary transfer bias is applied to the secondary transfer outer roller 62, whereby the toner images, primary-transferred on the intermediary transfer belt 54, are secondary-transferred onto the sheet S by the secondary transfer unit 60.

The unshown fixing portion includes a fixing roller and a pressing roller, and the sheet S is nipped and fed between the fixing roller and the pressing roller, so that the toner images transferred on the sheet S are pressed and heated and thus are fixed on the sheet S.

Figure 2:
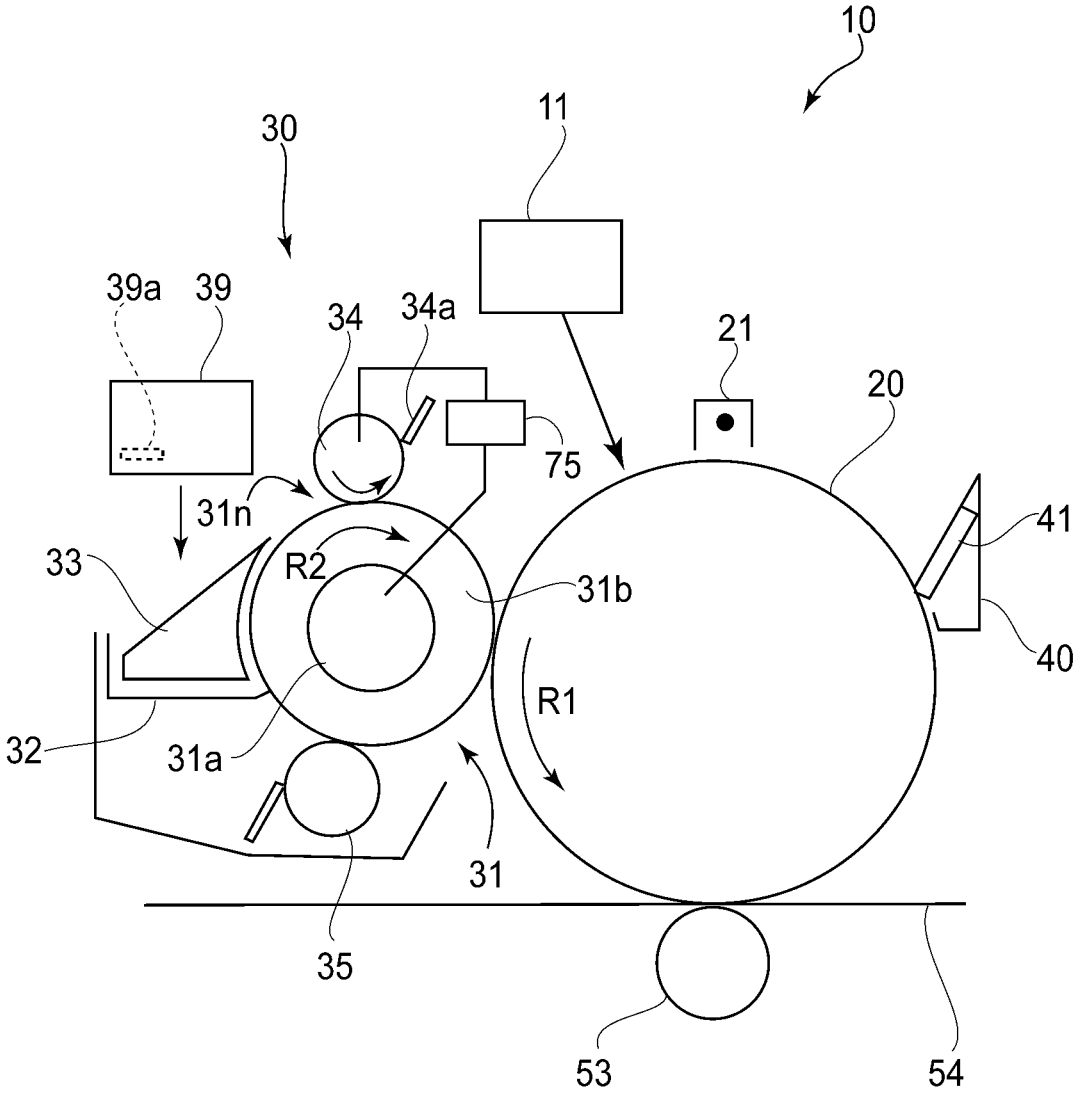
FIG. 2 is a schematic sectional view showing an image forming unit of the image forming apparatus according to the First Embodiment.

Next, a constitution of the developing device 30 in this embodiment will be specifically described using FIG. 2. The developing device 30 includes the developing roller 31 for feeding the liquid developer toward the photosensitive drum 20 while carrying the liquid developer, a developing liquid tank 32, a film forming electrode 33, an squeeze roller (electroconductive member) 34 and a cleaning roller 35.

The developing roller 31 is a cylindrical member of 45 mm in diameter and rotates about a center shaft 31*a* in a rotational direction R2. The developing roller 31 includes a 5 mm-thick surface layer 31*b* formed of an elastic member by an electroconductive polymer or the like on an outer peripheral portion of the center shaft 31*a* which is an inner core made of metal such as stainless steel. The developing roller 31 is disposed opposed to the photosensitive drum 20 so as to form a number between itself and the photosensitive drum 20, and at the nip, a developing nip is formed. In this embodiment, the surface layer 31*b* of the developing roller 31 is made of an electroconductive urethane rubber, and in an initial state, inside the surface layer 31*b*, an ion conductive agent is uniformly dispersed, so that volume resistivity is adjusted. Incidentally, the volume resistivity of the developing roller 31 used in this embodiment is $5\times10^6$-$5\times10^7$ Ω·cm inclusive of a variation. That is, the developing roller 31 is rotatable while carrying the liquid developer containing the toner and the contact, and contains the electroconductive agent. Incidentally, to the developing roller 31, a developing roller voltage source 73 (see FIG. 3) capable of applying a voltage is connected.

As a material of the surface layer 31*b* of this developing roller 31, for example, the following materials are applied. First, an appropriate resin is selected from EPDM, urethane, silicone, nitrile-butadiene rubber, chloroprene rubber, styrene-butadiene rubber, butadiene rubber, and the like. Then, into this selected resin, as an electric resistance adjusting material, electroconductive particles, for example, either one or a plurality of carbon (back) and titanium oxide are used, and are dispersed and mixed, and it is appropriate to use a material based on a dispersion-type resistance-adjusting resin. Further, when a foaming material is used as a foaming and mixing step for obtaining elasticity, it is appropriate to use a silicone-based surfactant (for example, polydiallylsiloxane, polysiloxane-polyalkyleneoxide block copolymer).

The developing liquid tank 32 is disposed on a side substantially opposite from the photosensitive drum with the developing roller 31 as a center, and accommodates the liquid developer for developing the latent image formed on the photosensitive drum 20. The liquid developer used in this embodiment is formed by adding particles of 0.8 μm in average particle size of a colorant such as a pigment into a polyester-based resin, together with a dispersing agent, a toner charge control agent and a charge directing agent into the liquid carrier such as an organic solvent of an isoparaffine type. Further, the liquid developer in this embodiment is about 7 wt. % in concentration of the toner particles. Incidentally, in this embodiment, the surfaces of the toner particles are charged to the negative polarity in a certain amount.

The film forming electrode 33 contacts the liquid developer stored in the developing liquid tank 32 and is disposed close and opposed to the developing roller 31 with a gap from the developing roller 31. The liquid developer enters between the film forming electrode 33 and the developing roller 31, and the liquid developer is formed in a film (layer) on the developing roller 31, and in addition, a potential difference is set between the film forming electrode 33 and the developing roller 31, whereby a toner concentration of the liquid developer on the surface of the developing roller 31 is adjustable. In this embodiment, the potential difference between the film forming electrode 33 and the developing roller 31 is adjusted so that the toner concentration of the liquid developer after passing through the film forming electrode 33 is 12.5±2.5 wt. %.

The squeeze roller 34 is disposed on a side downstream of the film forming electrode 33 with respect to a rotational direction R2 and is disposed in contact with the developing roller 31 through at least the carrier liquid. The squeeze roller 34 shifts the toner particles, contained in the liquid developer formed in a film (layer) on the developing roller, toward the developing roller 31 side by application of a voltage, and in addition, an excessive carrier liquid is squeezed and collected, so that the concentration of the liquid developer carried on the developing roller 31 is adjustable. The squeeze roller 34 is a cylindrical member made of metal in a diameter of 40 mm, and in this embodiment, a roller prepared by a stainless steel is used. The squeeze roller 34 is contacted to the developing roller 31 so that a pressure is constant (almost 80 kPa in this embodiment) over a longitudinal length of almost 300 mm, and rotates about a center axis in an arrow direction. Incidentally, to the squeeze roller 34, a squeeze roller voltage source 74 (see FIG. 3) capable of applying a voltage is connected.

The liquid developer which is drawn up from the developing liquid tank 32 and which passed toner the film forming electrode 33 is carried on the developing roller 31 in a certain amount. For that reason, the liquid developer fed at a predetermined speed to a contact portion between the squeeze roller 34 and the developing roller 31 stably forms a nip 31*n* of almost 6 μm in gap and almost 5 mm in width. The liquid developer is adhered to and separated from the respective rollers 34 and 31 on an open side of the nip 31*n* between the squeeze roller 34 and the controller 31. As described later, a predetermined potential difference is set between both the rollers 34 and 31 so as to perform an operation in which the toner shifts toward the developing roller 31 side. For this reason, the toner concentration in the liquid developer at the surface of the developing roller 31 after passing between the rollers 34 and 31 is about twice the toner concentration before passing between the rollers 34 and 31, i.e., 25.0±5.0 wt. %.

The cleaning roller 35 is disposed in contact with the developing roller 31 on a side downstream of the developing nip between the developing roller 31 and the photosensitive drum with respect to the rotational direction R2. The cleaning roller 35 is a roller made of metal or the like, and removes the liquid developer, remaining on the surface of the developing roller 31, in contact with the developing roller 31.

Figure 3:
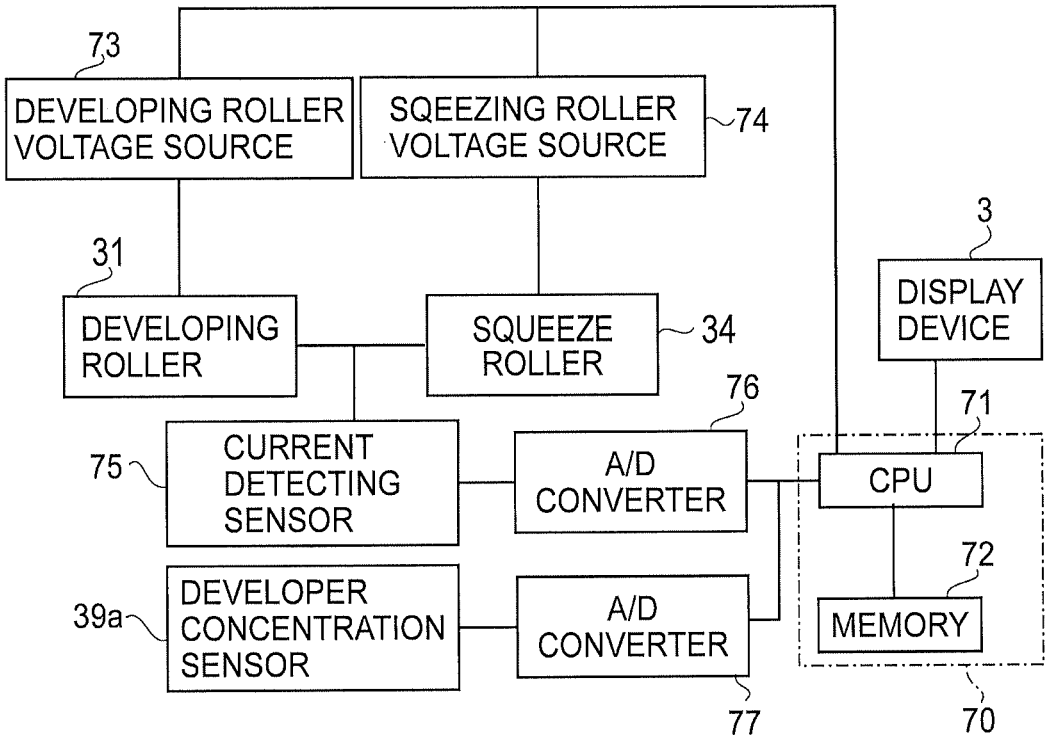
FIG. 3 is a schematic illustration showing a control block diagram of the image forming apparatus according to the First Embodiment.

As shown in FIG. 3, the controller 70 is constituted by a computer and is provided with, for example, a CPU 71, a memory 72 and an unshown input and output circuit for inputting and outputting signals between itself and an outside portion. The memory 72 includes a ROM for storing programs for controlling respective portions and includes a RAM for temporarily storing data. The CPU 71 is a microprocessor managing entirety of control of the image forming apparatus 1 and is a main body of a system controller. The CPU 71 is connected to the respective portions of the image forming apparatus 1, such as the image forming portion 2, through the input and output circuit, and not only transfers the signals between itself and the respective portions but also controls operations of the respective portions. In the ROM of the memory 72, an image formation control sequence for forming the image on the sheet S and the like are stored. Further, the display device 3 is, for example, a liquid crystal panel combined with an operating portion, and is connected to the CPU 71, so that the display device 3 is capable of displaying (outputting) information on a lifetime of the developing roller 31 by display. Here, the information on the lifetime of the developing roller 31 is, for example, displayed to the effect of prompting exchange, such as display to the effect that the developing roller 31 approaches an exchange time (timing) or display to the effect that the developing roller 31 reaches the exchange time.

Further, to the developing roller 31, a developing roller voltage source (voltage applying means) 73 is connected, and to the squeeze roller 34, a squeeze roller voltage source (voltage applying means) 74 is connected. These voltage sources 73 and 74 are connected to the CPU 71 and are controlled by the CPU 71, so that a potential difference is capable of generating between the developing roller 31 and the squeeze roller 34. Further, between the developing roller 31 and the squeeze roller 34, a current detecting sensor (current detecting means) 75 for detecting a current passing between the developing roller 31 and squeeze roller 34 is provided. A signal detected by this current detecting sensor 75 is inputted to the CPU 71 through an A/D converter 76. Further, a signal detected by the developer concentration sensor 39*a* of the developer mixer 39 is inputted to the CPU 71 through an A/D converter 77.

The controller 70 is capable of controlling the respective voltage sources 73 and 74, and when a predetermined potential difference is generated between the developing roller 31 and the squeeze roller 34 by the voltage sources 73 and 74, the controller 70 outputs the information on the lifetime from the display device 3 on the basis of a detection result by the current detecting sensor 75. In this embodiment, when the predetermined potential difference is generated by the voltage sources 73 and 74, the controller 70 supplies the carrier liquid to between the developing roller 31 and the squeeze roller 34. During non-image formation, when the predetermined potential difference is generated between the developing roller 31 and the squeeze roller 34 by the voltage sources 73 and 74, the controller 70 is capable of executing a lifetime detecting mode, in which the information on the lifetime is outputted from the display device 3, on the basis of the detection result by the current detecting sensor 75.

Here, in the present specification, during image formation is the time (period) in which the toner image is formed on the photosensitive drum 20 on the basis of image information inputted from a scanner provided to the image forming apparatus 1 or from an external terminal such as a personal computer. Further, during non-image formation is the time (period) other than during image formation, and for example, before execution or after execution of an image forming job after main switch actuation, during pre-rotation, a sheet interval, during post-rotation in the image forming job, and the like. Incidentally, the image forming job is the following series of operations performed on the basis of a print instruction signal (image formation instruction signal). That is, the image forming job is the series of operations from a start of a preparatory operation (pre-rotation) necessary for carrying out the image formation until a preparatory operation (post-rotation) necessary for ending the image formation is completed through an image forming step. The sheet interval is a period corresponding to an interval between a toner image formed on a single sheet and a toner image formed on a subsequent single sheet when the image formation is continuously carried out.

Next, an operation of the image forming apparatus 1 using the above-described developing device 30 will be described using FIG. 2 and FIG. 3. To the developing roller 31, a voltage of −400 V is applied by the developing roller voltage source 73. The toner concentration of the liquid developer in the developing liquid tank 32 is adjusted to about 5 wt. % in the developer mixer 39, and the toner particles have negative electric charges. On the surface of the developing roller 31, the liquid developer is carried when the developing roller surface passes from the developing liquid tank 32 to the film forming electrode 33. At this time, to the film forming electrode 33, a voltage of −550 to −600 V is applied, so that most of the toner particles are attracted to the surface of the developing roller 31 by the potential difference between itself and the developing roller 31. The liquid developer is separated into a liquid developer carried by the surface of the developing roller 31 and a liquid developer flowing down to a rear surface of the film forming electrode 33 in the neighborhood of an exit between the developing roller 31 and the film forming electrode 33. At this time, the toner concentration of the liquid developer on the surface of the developing roller 31 is 10 to 15 wt. %.

The liquid developer deposited on and carried by the surface of the developing roller 31 reaches the squeeze roller 34. To the squeeze roller 34, a voltage higher than the applied voltage of the developing roller 31 by 50 to 120 V is applied from the squeeze roller voltage source 74. That is, for example, when the applied voltage of the developing roller 31 is −400 V, the applied voltage of the squeeze roller 34 is −450 V to −520 V.

Here, motion of the toner in the nip 31*n* between the developing roller 31 and the squeeze roller 34 will be described using FIG. 4. The toner T contained in the liquid developer D carried on the developing roller 31 moves, during passing between the nip 31*n* with the squeeze roller 34, toward the developing roller 31 side by the potential difference generated between the rollers 31 and 34. When the liquid developer D passes between the squeeze roller 34 and the developing roller 31, the liquid developer D is deposited on and separated by both the rollers 34 and 31. At this time, the toner concentration of the liquid developer carried on the developing roller 31 is 20 to 30 wt. %. On the other hand, the toner T is little attracted toward the squeeze roller 34, so that the carrier liquid C in which a content of the toner T is remarkably small is carried. As shown in FIG. 2, the carrier liquid carried by the squeeze roller 34 is scraped off and removed from the surface of the squeeze roller 34 by a squeeze roller blade 34*a* constituted by a rubber or the like in contact with the surface of the squeeze roller 34. The liquid developer carried by the surface of the developing roller 31 reaches the photosensitive drum 20.

The photosensitive drum 20 is charged to almost −800 V by applying a voltage of about −4.5 kV to −5.5 kV to a wire of the charger 21 on an upstream side of the developing nip with the developing roller 31. After charging, the latent image is formed so that a potential of an image portion is almost 0 V by the laser exposure device 11.

In the developing nip formed between the developing roller 31 and the photosensitive drum 20, the toner particles move in the following manner. The toner particles selectively move toward the image portion on the photosensitive drum 20 in accordance with an electric field formed by a bias of −400 V applied to the developing roller 31 and the latent image (image portion: −100 V, non-image portion: −800 V) on the photosensitive drum 20. By this, the toner image is formed on the photosensitive drum 20. The carrier liquid is not influenced by the electric field, and therefore, is separated at the exit of the developing nip between the developing roller 31 and the photosensitive drum 20 and is deposited on both the developing roller 31 and the photosensitive drum 20.

The toner image passed through the developing nip on the photosensitive drum 20 reaches a nip with the intermediary transfer belt 54, so that primary transfer is carried out. To the primary transfer roller 53, a voltage of about +200 V of an opposite polarity to a charging characteristic of the toner particles is applied, so that the toner on the photosensitive drum 20 is primary-transferred onto the intermediary transfer belt 54 and only the carrier liquid remains on the photosensitive drum 20. The carrier liquid remaining on the photosensitive drum 20 is scraped off by the cleaning blade 41 disposed downstream of the primary transfer portion and is collected by the drum cleaner 40.

The toner images primary-transferred onto the intermediary transfer belt 54 at the primary transfer portions are moved toward the secondary transfer unit 60 as shown in FIG. 1. In the secondary transfer unit 60, to the secondary transfer outer roller 62, a voltage of +1000 V is applied and the secondary transfer inner roller 61 is maintained at 0 V, so that the toner particles on the intermediary transfer belt 54 are secondary-transferred onto the sheet S. Incidentally, the liquid developer remaining on the intermediary transfer belt 54 after secondary transfer is collected by an unshown intermediary transfer belt cleaning member.

In an image forming process by the image forming apparatus 1 of this embodiment, movement (transfer) efficiency in each of toner moving processes is required to be almost 95% or more, which is very high. For that reason, during image formation, in each of the developing devices 30, it is important for stabilizing an image quality of the images outputted on the sheets S that an amount of the toner contained in the liquid developer on the developing roller 31 at a position in front of the photosensitive drum 20 is stabilized with accuracy.

Therefore, in the image forming process by the image forming apparatus 1 of this embodiment, in each of the developing devices 30, the following procedure is executed for obtaining a resistance value Rg of the surface layer 31*b* in order to stabilize the amount of the toner on the developing roller 31. Here, a current generating when a certain voltage is applied between the squeeze roller 34 and the developing roller 31 is measured, and the resistance value Rg of the surface layer 31*b* of the developing roller 31 is calculated using a result of the measurement and a resistance value Rd of the developer existing roller both the rollers 34 and 31. In the following, a principal for calculating the resistance value Rg of the surface layer 31*b* of the developing roller 31 will be described specifically.

Figure 4:
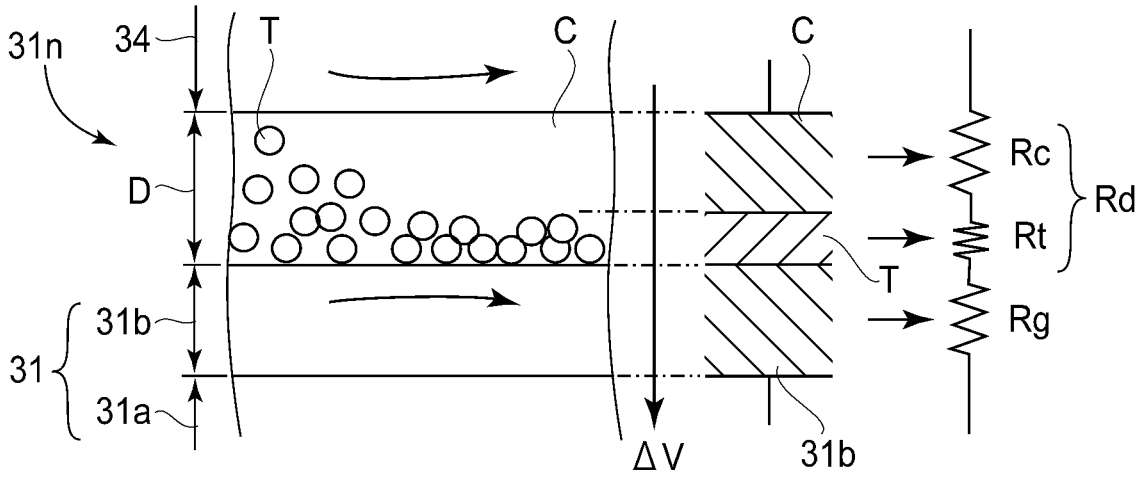
FIG. 4 is a schematic enlarged view showing a nip between a developing roller and a squeeze roller of the image forming apparatus according to the First Embodiment.

As shown in FIG. 4, in the nip 31*n* between the developing roller 31 and the squeeze roller 34, the squeeze roller 34 and the center shaft 31*a* of the developing roller 31 are made of metal and their resistance values are very small. On the other hand, the surface layer 31*b* of the developing roller 31 includes a resistance component (resistance value Rg) of an electroconductive layer such as an electroconductive polymer in which volume resistivity is adjusted. Further, the liquid developer D existing between the developing roller 31 and the squeeze roller 34 includes a resistance component (resistance value Rc) in the carrier liquid C and a resistance component (resistance value Rt) in the toner T. On the basis of this, the liquid developer D and the surface layer 31*b* of the developing roller 31 can be represented as an equivalent circuit including the respective resistance components.

Here, the case where a certain voltage ΔV is applied to between the squeeze roller 34 and the developing roller 31 will be considered. In the equivalent circuit shown in FIG. 4, a current I flowing between both the rollers 34 and 31 is determined by a total value of the resistance value Rg of the surface layer 31*b* of the developing roller 31, the resistance value Rc by the carrier liquid C, and the resistance value Rt by the toner T. When the resistance value Rd of the liquid developer D is Rd=Rc+Rt, the resistance value Rg of the surface layer 31*b* of the developing roller 31 can be calculated using the following symbolic formula 1.

$$Rg=(\Delta V/I)-Rd \quad (1)$$

From the symbolic formula 1, when the resistance value Rd of the liquid developer D is known, the current I flowing between both the rollers 34 and 31 is detected by applying the predetermined voltage ΔV to between the squeeze roller 34 and the developing roller 31, so that the resistance value Rg of the surface layer 31*b* of the developing roller 31 can be calculated. In this embodiment, the developer with the toner concentration of 0 wt. % (i.e., only the carrier liquid C) is formed in a film (layer) on the developing roller 31, and the resistance value Rg of the surface layer 31*b* of the developing roller 31 is measured. In this case, the resistance value Rd in the symbolic formula 1 is the resistance value Rc, so that a calculation formula of the resistance value Rg of the surface layer 31*b* of the developing roller 31 is the following symbolic formula 2.

$$Rg=(\Delta V/I)-Rc \quad (2)$$

In this embodiment, the resistance value Rc of the carrier liquid C is acquired by measurement or the like in advance. For that reason, the resistance value Rc is a known parameter, and the resistance value Rg of the surface layer 31*b* of the developing roller 31 can be calculated from the symbolic formula 2 by using the parameter. Incidentally, volume resistivity of the carrier liquid C used in this embodiment is almost $1\times10^{11}$ Ω·cm, and the resistance value measured in a system of this embodiment is almost $1\times10^{7}$ Ω·cm.

Next, a procedure in which the resistance value Rg of the surface layer 31*b* of the developing roller 31 is measured and the lifetime of the developing roller 31 is discriminated on the basis of the resistance value Rg will be described. As described above, the volume resistivity of the surface layer 31*b* of the developing roller 31 is optimized by dispersing and mixing the ion conductive agent. In this embodiment, the resistance value measured when only the carrier liquid C exists between the squeeze roller 34 and the developing roller 31 is almost $5\times10^{2}$ to $5\times10^{3}$Ω. With use of the developing roller 31, the ion conductive agent originally dispersed uniformly in the surface layer 31*b* causes localization, so that the volume resistivity of the surface layer 31*b* gradually increases.

Figure 5:
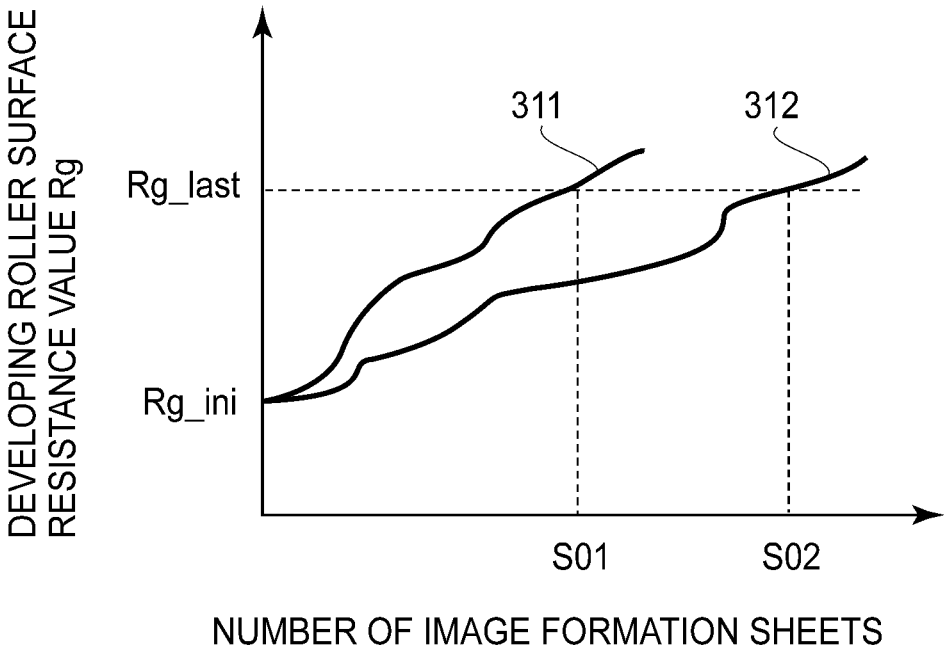
FIG. 5 is a graph showing a relationship between a number of image formation sheets and a resistance value of a surface layer of the developing roller in the image forming apparatus according to the first Embodiment.

For example, as shown in FIG. 5, the resistance value of the surface layer 31*b* of the developing roller 31 measured under a certain condition gradually increases with an increase in number of image formation sheets. Incidentally, in FIG. 5, Rg_ini is the resistance value Rg of the surface layer 31*b* of the developing roller 31 before use, and Rg_last is the resistance value Rg of the surface layer 31*b* of the developing roller 31 which reaches an end of the lifetime. Here, as regards a first developing roller 311, discrimination that the first developing roller 311 reaches the end of the lifetime when the number of image formation sheets reaches S01 is made, and as regards a second developing roller 312, discrimination that the second developing roller 312 reaches the end of the lifetime when the number of image formation sheets reaches S02 is made. Thus, the lifetime of each of the developing rollers can be individually discriminated.

With an increase in volume resistivity of the surface layer of the developing roller 31, a shearing voltage of the surface layer 31*b* of the developing roller 31 in the developing nip, i.e., between the developing roller 31 and the photosensitive drum 20, increases and causes a lowering in developing property. In this embodiment, when the volume resistivity of the surface layer 31*b* of the developing roller 31 reaches 15% of the volume resistivity of the carrier liquid, discrimination that the developing roller 31 reaches the end of the lifetime is made, and a user is prompted to exchange the developing roller 31. In the case of this embodiment, the volume resistivity corresponding to the end of the lifetime of the developing roller 31 is almost $1.5\times10^{10}$ Ω·cm, and at that time, the volume resistivity measured in the system of this embodiment is almost $1.5\times10^{6}\Omega$.

Figure 6:
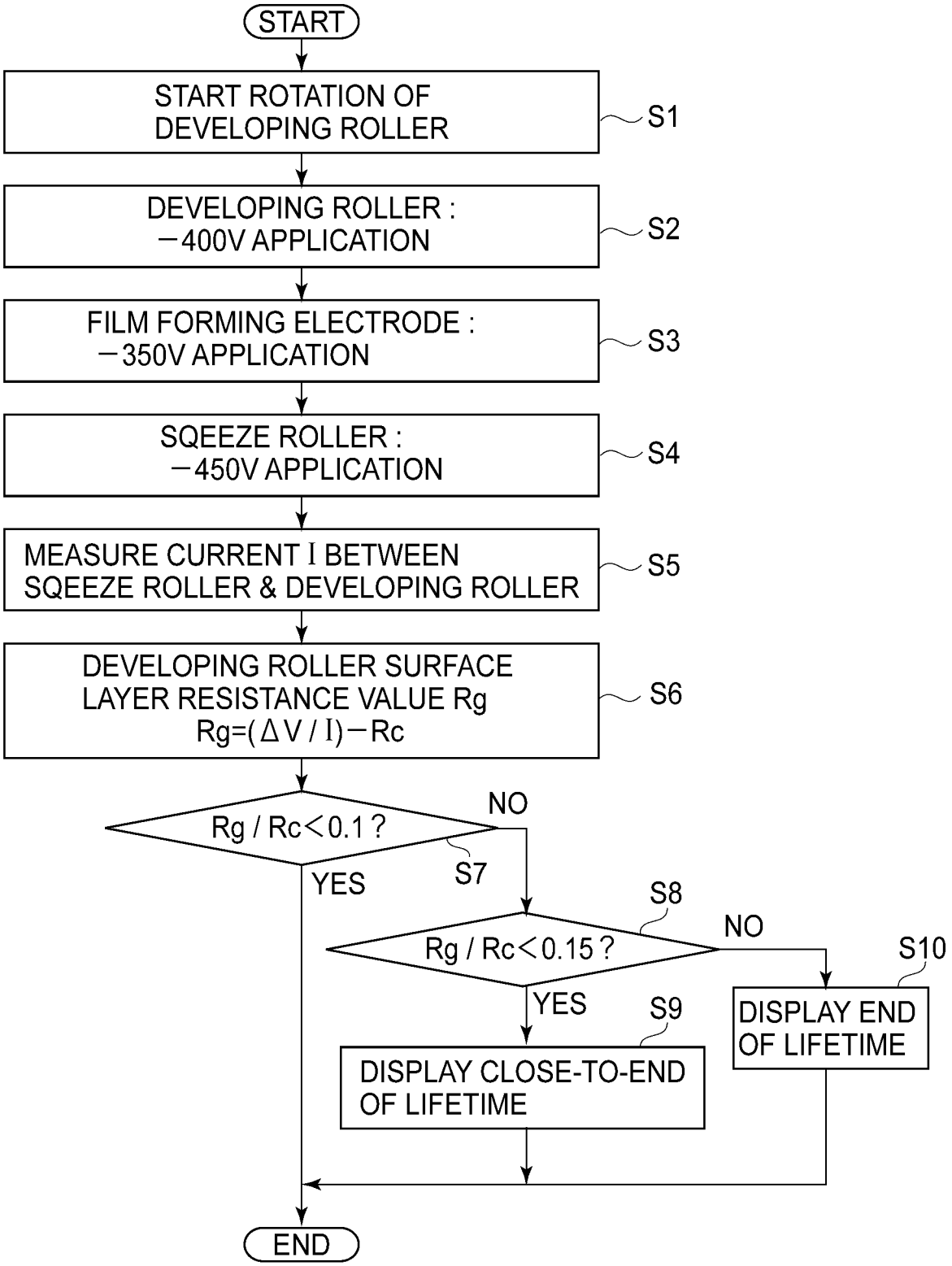
FIG. 6 is a flowchart showing a process procedure of a lifetime detecting mode in the image forming apparatus according to the First Embodiment.

Next, a process procedure of a lifetime detecting mode (detecting mode) of the developing roller 31 by this embodiment will be described along a flow chart shown in FIG. 6. The controller 70 starts the lifetime detecting mode, for example, at the time of main switch actuation of the number of image formation sheets. Here, the lifetime detecting mode shown in this embodiment is carried out by forming only the carrier liquid in a film (layer) on the developing roller 31 when a current between the squeeze roller 34 and the developing roller 31 is measured, and therefore, it is desirable that interruption of continuous image formation is not invited. For this reason, the lifetime detecting mode may preferably be executed immediately after a main switch of the image forming apparatus 1 is turned on at the time of a start of business operations of a day, such as morning, for example.

After the start of the lifetime detecting mode, the controller 70 starts rotation of the developing roller 31 (step S1). In this embodiment, a peripheral speed of the developing roller 31 is 750 mm/s. At this time, the squeeze roller 34 contacts the developing roller 31 through the liquid developer and rotates at the same speed as the developing roller 31.

The controller 70 applies a voltage of −400 V to the developing roller 31 (step S2), and applies a voltage of −350 V to the film forming electrode 33 (step S3). At this time, the film forming electrode 33 has a voltage difference of +50 V relative to the developing roller 31, and therefore, the toner dispersed in the liquid developer is negatively charged and therefore is shifted toward the film forming electrode 33 side, so that the toner concentration of the liquid developer carried on the developing roller 31 is almost 0 wt. %. That is, in the lifetime detecting mode, when a predetermined potential difference is generated by the respective voltage sources 73 and 74, the carrier liquid is supplied to between the developing roller 31 and the squeeze roller 34.

The controller 70 applies a voltage of −450 to the squeeze roller 34 (step S4), and measures a current I generating between the squeeze roller 34 and the developing roller 31 by the current detecting sensor 75 (step S5). The measured current I is sent as digital information to the CPU 71 through the A/D converter 76. The CPU 71 makes reference to the known resistance value Rc of the carrier liquid stored in the memory 72, and calculates the resistance value Rg of the surface layer 31*b* of the developing roller 31 by using the symbolic formula 2 (step S6).

The controller 70 discriminates whether or not the calculated resistance value Rg of the surface layer 31*b* of the developing roller 31 is smaller than 10% of the resistance value Rc of the carrier liquid (step S7). When the controller 70 discriminated that the resistance value Rg is smaller than 10% of the resistance value Rc, the controller 70 regards the developing roller 31 as having latitude until the developing roller 31 reaches an end of a lifetime thereof, and ends the lifetime detecting mode.

When the controller 70 discriminated that the resistance value Rg is not smaller than 10% of the resistance value Rc, the controller 70 discriminates whether or not the resistance value Rg is smaller than 15% of the resistance value Rc (step S8). When the controller 70 discriminated that the resistance value Rg is smaller than 15% of the resistance value Rc, the controller 70 causes the display device 3 to display that the lifetime, i.e., an exchange time of the developing roller 31 comes near (information on the exchange) (step S9). Further, when the controller 70 discriminated that the resistance value Rg is not smaller than 15% of the resistance value Rc, the controller 70 causes the display device 3 to display that the developing roller 31 reaches the exchange time (information on the exchange) (step S10), and prompts the user to exchange the developing roller 31. That is, in the lifetime detecting mode, the controller 70 outputs information on the lifetime (information on the exchange) from the display device 3 on the basis of a detection result by the current detecting sensor 75 when the predetermined potential difference is generated between the developing roller 31 and the squeeze roller 34 by the voltage sources 73 and 74. Here, the controller 70 does not output the information on the lifetime when the resistance value Rg calculated from the detection result by the current detecting sensor 75 is less than 10% of the known resistance value Rc, and outputs the information on the lifetime when the resistance value Rg is 10% or more of the known resistance value Rc.

As described above, according to the image forming apparatus 1 of this embodiment, on the basis of the detection result of the detection of the current flowing between the developing roller 31 and the squeeze roller 34 by the current detecting sensor 75, the controller 70 causes the display device 3 to output the information on the lifetime (exchange). For this reason, when the electric characteristic of the developing roller 31 deteriorates and the volume resistivity increases, compared with the case where the lifetime of the developing roller 31 is determined simply depending on the number of image formation sheets, actual deterioration of the developing roller 31 can be detected. That is, when the resistance of the developing roller is a first resistance value smaller than a predetermined resistance value (resistance value for exchange), the information is not outputted, when the resistance of the developing roller is a first resistance value smaller than a predetermined resistance value, the information is not outputted, and when the resistance of the developing roller is a second resistance value larger than the predetermined resistance value, the information is outputted. Or, when the resistance of the electroconductive layer of the developing roller is the first resistance value smaller than the predetermined resistance value (resistance value for exchange), the information is not outputted, and when the resistance of the developing roller is the second resistance value larger than the predetermined resistance value, the information is outputted. By this, the lifetime (exchange time) of the developing roller 31 can be individually discriminated with high accuracy. Further, by discriminating the lifetime of the developing roller 31 with high accuracy, the user is capable of exchanging the developing roller 31 at proper timing, so that a running cost can be reduced.

Further, according to the image forming apparatus 1 of this embodiment, in the lifetime detecting mode, the controller 70 supplies the carrier liquid to between the developing roller 31 and the squeeze roller 34 when the predetermined potential difference is generated by the voltage sources 73 and 74. For this reason, compared with the case where the liquid developer containing toners in mixture is supplied, the symbolic formula for calculating the resistance value Rg of the surface layer 31*b* can be simplified. That is, a parameter other than the voltage V and the current I can be made only the known resistance value Rc of the carrier liquid, so that calculation accuracy of the resistance value Rg can be improved.

Further, according to the image forming apparatus 1 of this embodiment, as the electroconductive member for energizing the developing roller 31 in the lifetime detecting mode, the squeeze roller 34 is applied. For this reason, the squeeze roller 34 is positioned on a mostupstram side after the liquid developer is formed in a film on the developing roller 31 and is not affected by the image to be formed, and is made of the metal for which there is no need to consider a shearing voltage when the squeeze roller 34 is regarded as an electrode, so that the lifetime of the developing roller 31 can be discriminated with further high accuracy.

Second Embodiment

Figure 7:
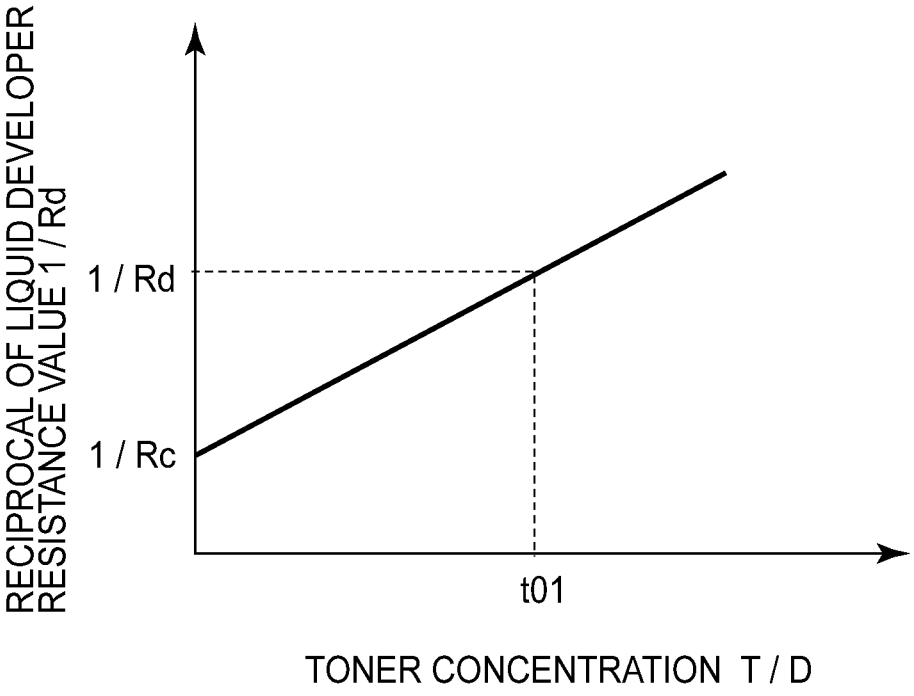
FIG. 7 is a graph showing a relationship between a toner concentration of a liquid developer and the reciprocal of a resistance value of the liquid developer in an image forming apparatus according to a Second Embodiment.
Figure 8:
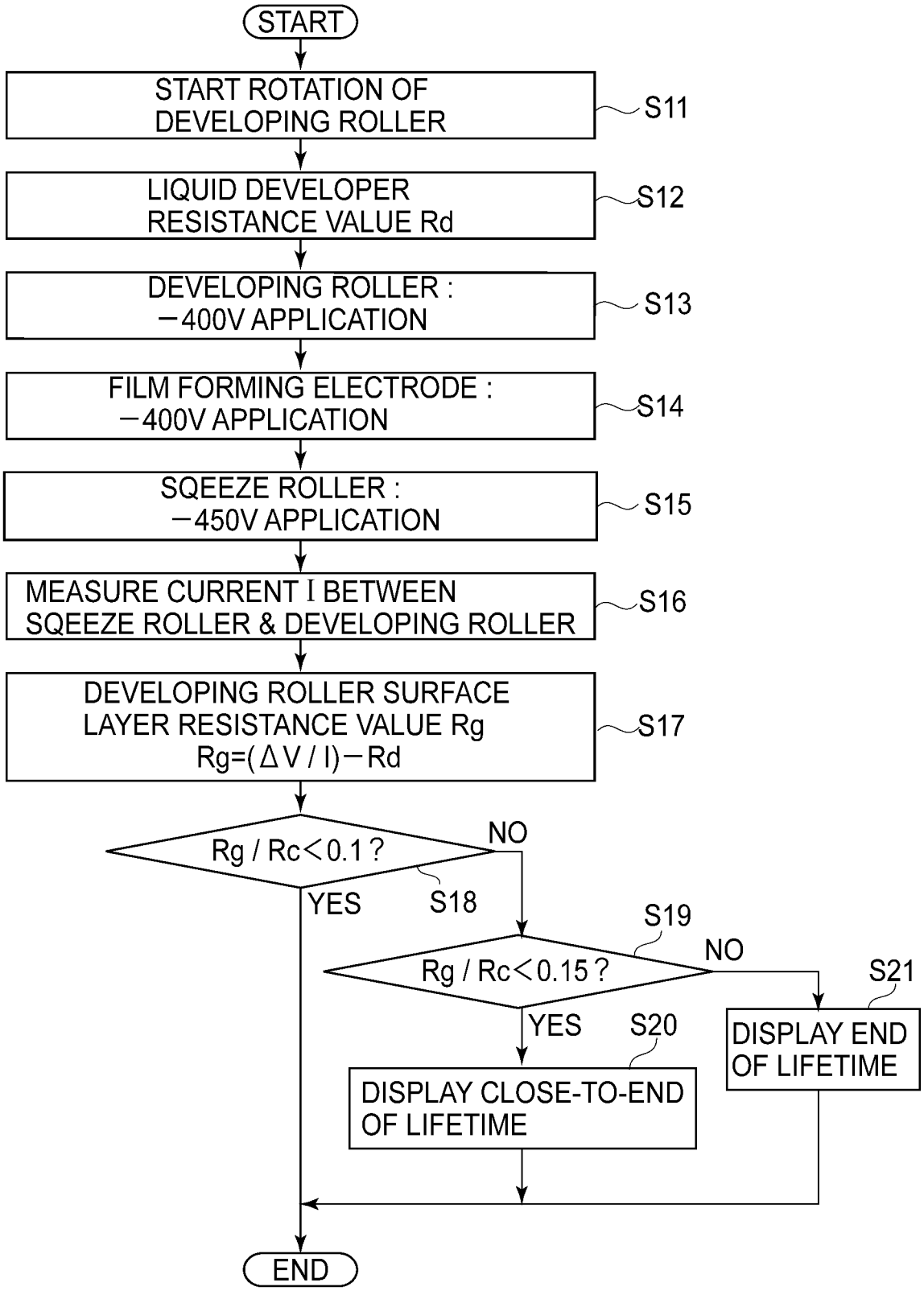
FIG. 8 is a flowchart showing a process procedure of the lifetime detecting mode in the image forming apparatus according to the Second Embodiment.

Next, a Second Embodiment of the present invention will be specifically described while making reference to FIG. 7 and FIG. 8. In this embodiment, a constitution is different from the First Embodiment in that in the lifetime detecting mode, the controller 70 supplies the liquid developer to between the developing roller 31 and the squeeze roller 34 when the predetermined potential difference is generated by the voltage sources 73 and 74. That is, in this embodiment, the controller 70 supplies the liquid developer to between the developing roller 31 and the squeeze roller 34 when the predetermined potential difference is generated by the voltage sources 73 and 74, and causes the display device 3 to output the information on the lifetime on the basis of a detection result by the developer concentration sensor 39*a*. However, as regards other constitutions, the constitutions are similar to those of the First Embodiment, and therefore, the same reference numerals or symbols are used and detailed description thereof will be omitted.

In this embodiment, a sequence for forming only the carrier liquid in a film on the surface of the developing roller 31 as in the First Embodiment is not provided. In this embodiment, the liquid developer in the developing liquid tank 32 is formed in a film while unchanging the concentration thereof, and a current flowing between both the rollers 31 and 34 when a certain voltage is applied between the squeeze roller 34 and the developing roller 31 is measured, and the resistance value Rg of the surface layer 31*b* of the developing roller 31 is acquired. In the following, a principal for calculating the resistance value Rg of the surface layer 31*b* of the developing roller 31 will be described specifically.

In the liquid developer, electrical conductivity (reciprocal of volume resistivity) of the toner particles is about $10^2$ times that of the carrier liquid. Electrical conductivity of the liquid developer increases substantially in proportion to a weight percentage concentration (T/D) [wt. %] of the toner occupied in the entirety of the liquid developer, and therefore, the reciprocal 1/Rd of the resistance value of the developer measured by the method of this embodiment linearly increases relative to T/D (t01) of the developer as shown in FIG. 7. For that reason, when a slope of dependency of 1/Rd on T/D is a, the resistance value Rd of the developer is represented by the following symbolic formula.

$$Rd=1/\{(1/Rc)+a\cdot(T/D)\} \quad (3)$$

In this embodiment, the resistance value Rc of the carrier liquid and the slope a of the dependency of 1/Rc on T/D are grasped in advance. Further, T/D of the liquid developer in the developing liquid tank 32 is detected using the developer concentration sensor 39*a*. By these, the resistance value Rd of the liquid developer can be calculated using the symbolic formula 3, and from the resultant resistance value Rd of the liquid developer and the current I between the squeeze roller 34 and the developing roller 31, the resistance value Rg of the surface layer 31*b* of the developing roller 31 is calculated using the symbolic formula 1.

Next, a process procedure of a lifetime detecting mode (detecting mode) of the surface layer 31*b* of the developing roller 31 by this embodiment will be described along a flow chart shown in FIG. 8. Incidentally, in this process procedure, a portion similar to the process procedure (see FIG. 6) of the First Embodiment is omitted from detailed description, and here, a different portion will be principally described. Further, in this embodiment, measurement of the current between the squeeze roller 34 and the developing roller 31 is carried out without changing T/D of the developer in the developing liquid tank 32, and therefore can be executed during an image forming job, for example. For this reason, the lifetime detecting mode can be executed every predetermined number of sheets subjected to the image formation, in addition to immediately after a main switch of the image forming apparatus 1 is turned on at the time of a start of business operations of a day, for example.

After the start of the lifetime detecting mode, the controller 70 starts rotation of the developing roller 31 (step S11). The controller 70 detects T/D of the developer in the developing liquid tank 32 by using the developer concentration sensor 39*a*, and calculates the resistance value Rd of the developer from the symbolic formula 3 by utilizing the known resistance value Rc of the carrier liquid and the slope a of 1/Rd vs. T/D (step S12). The controller 70 applies a voltage of −400 V to the developing roller 31 (step S13), and applies a voltage of −400 V, which is equal to the potential of the developing roller 31, to the film forming electrode 33 (step S14). At this time, the film forming electrode 33 has no potential difference relative to the developing roller 31, and therefore, the toner contained in the liquid developer passing through therebetween is not electrically shifted toward either of the members, and passes between the developing roller 31 and the film forming electrode 33 while T/D of the developer is kept uniform and is separated. Therefore, T/D of the developer subsequently passing and reaching the nip 31*n* between the squeeze roller 34 and the developing roller 31 is equal to T/D of the developer in the developing liquid tank 32. That is, in the lifetime detecting mode, when a predetermined potential difference is generated by the respective voltage sources 73 and 74, the liquid developer is supplied to between the developing roller 31 and the squeeze roller 34.

The controller 70 applies a voltage of −450 to the squeeze roller 34 (step S15), and measures a current I generating between the squeeze roller 34 and the developing roller 31 by the current detecting sensor 75 (step S16). The measured current I is sent as digital information to the CPU 71 through the A/D converter 76. The CPU 71 makes reference to the resistance value Rd calculated in the step S12, and calculates the resistance value Rg of the surface layer 31*b* of the developing roller 31 by using the symbolic formula 2 (step S17).

Thereafter, similarly as in the First Embodiment, when the resistance value Rg of the surface is smaller than 10% of the resistance value Rc of the carrier liquid (step S18), the controller 70 regards the developing roller 31 as having latitude until the developing roller 31 reaches an end of a lifetime thereof, and ends the lifetime detecting mode. Further, when the resistance value Rg is larger than 10% of the resistance value Rc (step S18) and is smaller than 15% of the Rc (step S19), the controller 70 causes the display device 3 to display that the lifetime, i.e., an exchange time of the developing roller 31 comes near (information on the exchange) (step S20). Further, when the controller 70 discriminated that the resistance value Rg is not smaller than 15% of the resistance value Rc, the controller 70 causes the display device 3 to display that the developing roller 31 reaches the exchange time (information on the exchange) (step S21).

Also by the above-described image forming apparatus 1 of this embodiment, on the basis of the detection result of the detection of the current flowing between the developing roller 31 and the squeeze roller 34 by the current detecting sensor 75, the controller 70 causes the display device 3 to output the information on the lifetime (exchange). For this reason, when the electric characteristic of the developing roller 31 deteriorates and the volume resistivity increases, compared with the case where the lifetime of the developing roller 31 is determined simply depending on the number of image formation sheets, actual deterioration of the developing roller 31 can be detected. By this, the lifetime (exchange time) of the developing roller 31 can be individually discriminated with high accuracy. Further, by discriminating the lifetime of the developing roller 31 with high accuracy, the user is capable of exchanging the developing roller 31 at proper timing, so that a running cost can be reduced.

Further, according to the image forming apparatus 1 of this embodiment, in the lifetime detecting mode, the controller 70 carried out measurement of the current between the squeeze roller 34 and the developing roller 31 without changing T/D of the liquid developer in the developing liquid tank 32. For this reason, the lifetime detecting mode can be executed, for example, during the image forming job, and compared with the case where the lifetime detecting mode is executed at the time of the start of the business operations of the day, latitude of timing of execution of the lifetime detecting mode can be enhanced, for example, in a manner that the lifetime detecting mode is executed every 10,000 sheets in terms of the number of image formation sheets.

In the image forming apparatuses 1 of the above-described First and Second Embodiments, the display device 3 is applied as the output means, and display to the effect of prompting the exchange of the developing roller 31 is applied as the information on the lifetime to be outputted, but the present invention is not limited thereto. For example, a device capable of generating a warning sound may also be applied as the output means, and the warning sound prompting the exchange of the developing roller 31 may also be applied as the information on the lifetime to be outputted. Or, a circuit capable of sending a signal may also be applied as the output means, and a signal for stopping the image forming process or a warning signal sent toward the external device such as a computer may also be applied as the information on the lifetime.

Further, in the image forming apparatuses 1 of the First and Second Embodiments, as the electroconductive member for energizing the developing roller 31 in the lifetime detecting mode, the squeeze roller 34 is applied, but the present invention is not limited thereto. As the electroconductive member, other than the squeeze roller 34, other members adjacent to the developing roller 31 may also be utilized as electrodes, and for example, the film forming electrode 33, the photosensitive drum 20 and the cleaning roller 35 may also be applied.

Further, in the image forming apparatuses of the First and Second Embodiments, the toner concentration of the liquid developer supplied to the nip 31*n* between the developing roller 31 and the squeeze roller 34 was 0% or the same concentration as that of the liquid developer in the developing liquid tank 32, but the present invention is not limited thereto. For example, an arbitrary toner concentration between these rollers may also be used. In this case, volume resistivity at a set toner concentration is prepared in advance, and the resistance value Rg of the surface layer 31*b* is calculated from the symbolic formula 1 by utilizing the volume resistivity.

The number of image formation sheets until the developing roller 31 reaches the end of the lifetime was measured utilizing the above-described image forming apparatus 1. Here, three image forming apparatuses determined so that a developing roller of each image forming apparatus reaches the end of the lifetime in the number of image formation sheets of 3,500 k sheets were utilized as Embodiments 1 to 3, respectively, and the lifetime of the developing roller 31 was measured by applying the controller 70 according to the above-described First Embodiment. A result thereof is shown in Table 1.

TABLE 1

| | Lifetime sheet number (×1000 sheets) |
|---|---|
| Embodiment 1 | 4781 |
| Embodiment 2 | 3687 |
| Embodiment 3 | 5760 |

As shown in Table 1, it was confirmed that by measuring an actual lifetime of the developing roller 31 by the First Embodiment, compared with the case where the lifetime of the developing roller 31 is determined by the number of image formation sheets, the developing roller 31 can be used over a proper period. Incidentally, also by the image forming apparatus 1 of the Second Embodiment, a similar result was able to be obtained. Accordingly, it was confirmed that by using the image forming apparatuses 1 of these embodiments, a circumstance, such that the developing roller is exchanged although the developing roller is still usable, caused as when the lifetime is determined by the number of image formation sheets can be prevented. Further, it was confirmed that it is possible to provide an image forming apparatus properly reduced in running cost, to the user.

INDUSTRIAL APPLICABILITY

According to the present invention, there is provided an image forming apparatus in which the electrostatic latent image is developed by the wet developing type with use of the liquid developer in which the toner is dispersed in the medium liquid.

EXPLANATION OF SYMBOLS

1 . . . image forming apparatus, 3 . . . display device (output means), 31 . . . developing roller, 33 . . . film forming electrode, 34 . . . squeeze roller (electroconductive member), 39*a* . . . developer concentration sensor (toner concentration detecting means), 70 . . . controller, 73 . . . developing roller voltage source (voltage applying means), 74 . . . squeeze roller voltage source (voltage applying means), 75 . . . current detecting sensor (current detecting means), C . . . carrier liquid, D . . . liquid developer, T . . . toner.

The invention claimed is:

1. An image forming apparatus comprising:

a developing roller which is rotatable while carrying a liquid developer containing toner and a carrier liquid and which includes an electroconductive layer containing a conductive agent;

an electroconductive member for urging said developing roller;

a voltage source for forming a potential difference between said developing roller and said electroconductive member;

a current detector for detecting a current flowing between said developing roller and said electroconductive member;

a toner concentration detector capable of detecting a toner concentration of the liquid developer supplied to said developing roller; and a controller for outputting information relating to exchange of said developing roller, wherein said controller outputs the information relating to the exchange of said developing roller based on both the current flowing between said developing roller and said electroconductive member detected by said current detector and the toner concentration of the liquid developer supplied to said developing roller and detected by said toner concentration detector when said voltage source forms the potential difference between said developing roller and said electroconductive member.

2. An image forming apparatus according to claim 1, wherein said voltage source forms the predetermined potential difference between said developing roller and said electroconductive member when the carrier liquid is applied onto said developing roller, and said controller outputs the information relating to the exchange of said developing roller based on the current value detected by said current detector.

3. An image forming apparatus according to claim 1, wherein said electroconductive member is a regulating roller for regulating an amount of the liquid developer on said developing roller.

4. An image forming apparatus according to claim 3, wherein said regulating roller is a metal roller.

5. An image forming apparatus according to claim 1, wherein said developing roller includes the electroconductive layer on a metal roller.

6. An image forming apparatus according to claim 1, further comprising an operating portion for operating said image forming apparatus, wherein the information relating to the exchange of said developing roller is displayed at said operating portion.

* * * * *